US009422038B2

(12) United States Patent
Rowden

(10) Patent No.: US 9,422,038 B2
(45) Date of Patent: Aug. 23, 2016

(54) SUBMERSIBLE PERSONAL FLOTATION DEVICE

(71) Applicant: Christopher Morgan Rowden, Sarasota, FL (US)

(72) Inventor: Christopher Morgan Rowden, Sarasota, FL (US)

( * ) Notice: Subject to any disclaimer, the term of this patent is extended or adjusted under 35 U.S.C. 154(b) by 0 days.

(21) Appl. No.: 14/727,764

(22) Filed: Jun. 1, 2015

(65) Prior Publication Data

US 2015/0375834 A1 Dec. 31, 2015

Related U.S. Application Data

(60) Provisional application No. 62/017,968, filed on Jun. 27, 2014.

(51) Int. Cl.

| | |
|---|---|
| ***B63C 9/08*** | (2006.01) |
| ***B63C 9/28*** | (2006.01) |
| ***B63B 35/74*** | (2006.01) |
| ***A61H 37/00*** | (2006.01) |

(52) U.S. Cl.

CPC ..... *B63B 35/74* (2013.01); *A61H 37/005* (2013.01)

(58) Field of Classification Search

CPC ..... B63B 35/00; B63B 35/73; B63B 35/74; B63B 2035/00; B63B 2035/73; B63B 35/737; B63B 5/00; B63B 5/24; B63B 43/00; B63B 43/02; B63B 43/04; B63B 43/06; B63B 43/10

USPC ..... 441/129, 130

See application file for complete search history.

(56) References Cited

U.S. PATENT DOCUMENTS

| | | | | | |
|---|---|---|---|---|---|
| 2,013,410 | A * | 9/1935 | Howland | B63B 35/73 | 441/130 |
| 3,528,116 | A * | 9/1970 | Fenar | B63C 9/08 | 297/DIG. 1 |
| 4,718,661 | A * | 1/1988 | Wolfe | B63B 35/73 | 273/447 |
| 4,962,921 | A * | 10/1990 | Simmons | B63B 35/73 | 441/129 |
| 5,443,409 | A * | 8/1995 | Adamson | B63C 9/08 | 441/130 |
| 5,520,133 | A * | 5/1996 | Wiegert | B63B 35/731 | 114/125 |
| 2010/0210158 | A1* | 8/2010 | Coffournic | A63B 35/00 | 441/130 |
| 2012/0220175 | A1* | 8/2012 | Bertrand | B63B 1/121 | 440/6 |
| 2014/0235121 | A1* | 8/2014 | Hockenhull | B63B 35/74 | 441/130 |

* cited by examiner

*Primary Examiner* — Daniel V Venne

(74) *Attorney, Agent, or Firm* — Knox Patents; Kenneth C. Spafford

(57) ABSTRACT

A personal flotation device includes a hard outer shell, a seat, a centered leg straddle support, and a water ballast valve. The flotation device is fully submersible and has adjustable buoyancy that allows the user to sit upright on the device, floating at approximately armpit level in the water with the user's arms free and feet dangling down. The user can use his or her arms and legs to propel through the water, or perform other activities while floating because his or her hands are free to do so.

19 Claims, 16 Drawing Sheets

SUBMERSIBLE PERSONAL FLOTATION DEVICE

CROSS-REFERENCE TO RELATED APPLICATIONS

This application claims the benefit of U.S. Provisional Application No. 62/017,968, filed Jun. 27, 2014.

STATEMENT REGARDING FEDERALLY SPONSORED RESEARCH OR DEVELOPMENT

Not Applicable.

BACKGROUND

1. Field

This disclosure pertains to personal flotation devices.

More particularly, this disclosure pertains to fully submersible flotation devices that allow for hands-free operation while the user sits upright and mostly submerged in the water.

2. Description of the Related Art

Personal flotation devices are extremely popular for recreational use in the water. However, these devices can be uncomfortable and difficult to use because they require the user to hold on to the device or otherwise restrict use of the user's hands, arms, and legs. Most devices also require the user to float on top of the water rather than having the majority of the user's body under the water.

Moreover, personal flotation devices can be difficult to transport because they are either have bulky foam pieces or require inflating. An additional problem is that in order to float, the devices are either made of a light fragile material such as foam that is subject to breaking, or a fragile inflatable casing that is subject to puncturing. Most of these devices also do not accommodate users of different sizes, weights and buoyancies.

BRIEF SUMMARY

According to one embodiment of the present invention, a personal flotation device is provided. The device is comprised of a hard outer shell that is waterproof and hollow, and includes a seat and a raised leg straddle support centered at the front of the seat. A water ballast valve allows for water to enter or exit the shell thereby changing the buoyancy of the device. Internal support columns protect the device from crushing forces. A cavity on the bottom of the shell that is complementary to the shape of the raised straddle support allows for the devices to be stacked on top of one another. A handle extending from the device allows the device to be carried easily.

Is it is an object of the present disclosure to provide a flotation device that is lightweight, durable, relatively small, and easy to carry.

Is it is an object of the present disclosure to provide a flotation device that allows a user to sit upright in the water at chest level.

Is it is an object of the present disclosure to provide a flotation device that has an adjustable buoyancy and accommodates users of difference sizes and buoyancies.

Is it is an object of the present disclosure to provide a flotation device that will not break if sat upon on dry land.

Is it is an object of the present disclosure to provide a flotation device that is inexpensive to manufacture.

Is it is an object of the present disclosure to provide a flotation device that is stackable.

Is it is an object of the present disclosure to provide a flotation device that allow a user to operate the device hands-free.

Is it is an object of the present disclosure to provide a flotation device that is easy to clean.

BRIEF DESCRIPTION OF THE SEVERAL VIEWS OF THE DRAWINGS

The above-mentioned features will become more clearly understood from the following detailed description read together with the drawings in which.

REFERENCE NUMERALS

Figure 1B:
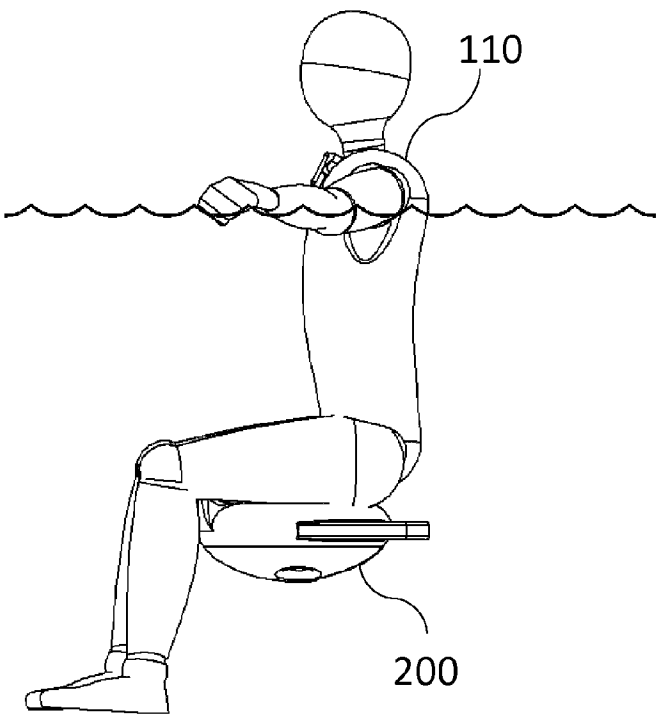
FIG. 1B displays a side view of the user and embodiment of FIG. 1A.

110 First user
200 Flotation device first embodiment
210 Shell
212 Seat
214 Raised leg straddle support
216 Shell side
218 Straddle support distal side
220 Straddle support proximal sides

222 Straddle support proximal sides
224 Internal support columns
226 Raised middle ridge
228 Handle
230 Handle attachment locations
232 Shell bottom
234 Threaded valve stem
236 Threaded cap
238 Tether
300 Cavity
700 Flotation device second embodiment
710 Shell
712 Seat
714 Raised leg straddle support
716 Shell side
718 Straddle support distal side
720 Straddle support proximal sides
722 Straddle support proximal sides
724 Internal support columns
728 Handle
730 Handle attachment locations
732 Shell bottom
734 Threaded valve stem
736 Threaded cap
738 Tether
740 Cavity
742 Stem recess
1100 Seat and main body
1110 Slots
1112 Recess
1200 Leg straddle support
1210 Tabs
1212 Proximal sides
1214 Proximal sides
1300 Bottom
1310 Threads
1400 Top
1410 Complementary threads
1500 Foam embodiment
1710 Second user

DETAILED DESCRIPTION

FIGS. 1, 2, 3, 4, 5, and 6 illustrate a flotation device first embodiment 200, which is comprised of a hard outer shell 210. The shell 210 and all parts of the embodiment 200 are comprised of a plastic such as high density polyethylene, although other materials known to those skilled in the art may be used as well. This embodiment 200 and shell 210 made through blow molding, although other methods such as injection molding and rotational molding are possible.

The top surface of the shell 210 includes a substantially concave seat 212 with a raised middle ridge 226, which is contiguous with a raised leg straddle support 214 whose proximal sides 220, 222 extend up from the front of seat 212. Two internal support columns 224 are hollow and open-ended and extend from seat 212 vertically down to shell bottom 232.

Extending from straddle support distal side 218 is a water ballast valve, displayed here as a threaded valve stem 234 which is coupled with a tether 238 to a threaded cap 236. Other variations of the valve arrangement, e.g., a spigot, or a plug, or where the cap needs minimal unthreading to allow water and air flow, may be used and are well-known to those with ordinary skill in the art.

Handle 228 extends from locations 230 on shell side surface 216, leaving a gap at handle 228 middle between handle and shell side surface 216.

Shell bottom surface 232 is curved and convex in a dome substantially hemispheric shape and includes the bottom ends of internal support columns 224. Cavity 300 on bottom surface 732 has a shape complementary to straddle support proximal sides 220, 222 such that multiple flotation devices 200 are operable to stack upright vertically, in alternating opposite directions. The cavity 300 shape also acts as a third support column, increasing the structural strength of the device 200.

FIGS. 7, 8, 9 and 10 illustrate a flotation device second embodiment 700, which includes certain structural differences from first embodiment 200. By way of example, seat 712 is concave and smooth and does not include raised middle ridge 226. Three internal support columns 724 extend from seat 712 to shell bottom surface 732. Water ballast valve 734 is threaded and located in stem recess 742 on shell side 716, which allows for the user's leg to avoid being pressed against the valve. Threaded cap 736 is coupled to water ballast valve 734 with tether 738.

Cavity 740 on shell bottom 732 is located directly below raised leg straddle support 714. The shape of cavity 740 is complementary to the straddle support proximal sides 720 such that multiple devices 700 can be stacked up on one another, each facing the same direction.

Referring to FIG. 15A, FIG. 15B, FIG. 15C, and FIG. 15D, another embodiment 1500 displays the device comprised out of hard foam. The primary difference between the embodiment 1500 and the ones previously disclosed is that a water ballast valve 234 is unnecessary, as the device 1500 is generally solid. Buoyancy will be predetermined and nonadjustable and a user must choose in advance a device 1500 of appropriate size and buoyancy. In other embodiments without a water ballast valve, the device may be made of material other than foam, as long as the embodiment has the appropriate positive buoyancy overall.

Figure 16:
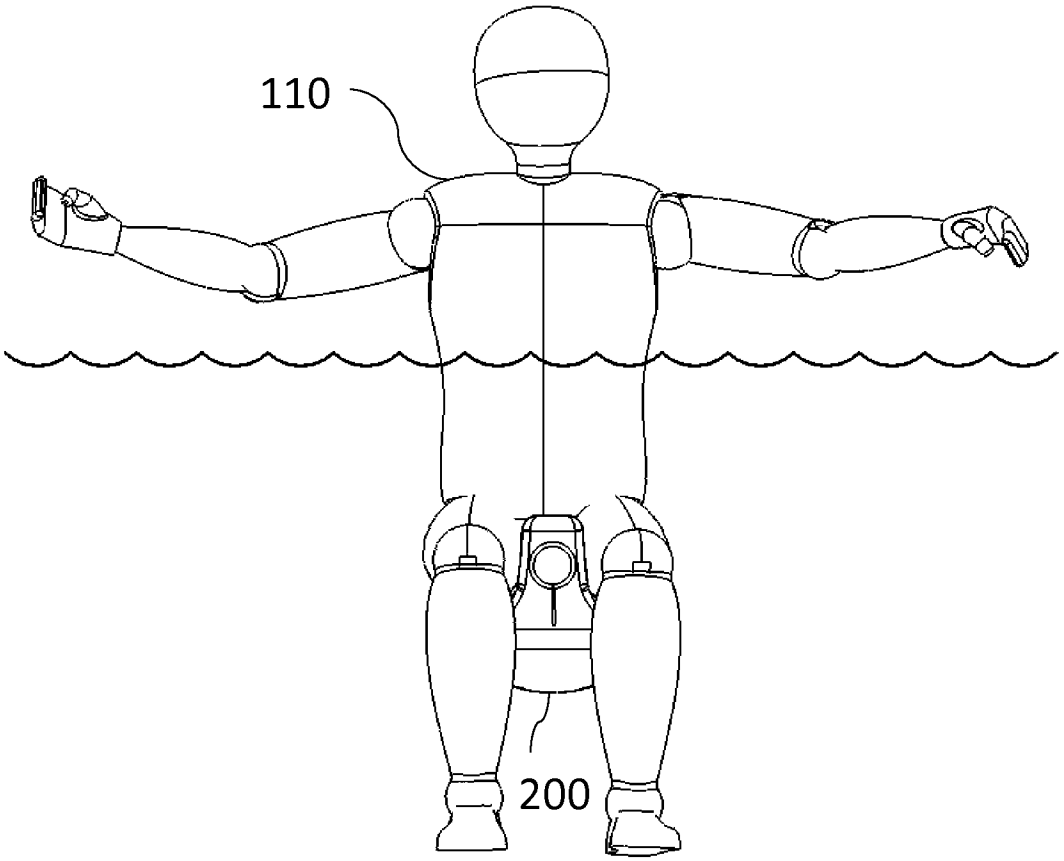
FIG. 16 displays the user of FIG. 1A using the embodiment of FIG. 1A.

Referring now to FIGS. 1A, 1B, 16, 17A, and 17B, a method for using the embodiment 200 at the appropriate equilibrium level will now be disclosed. A user first places the device 200 in the water and pushes it down in order to sit on the device. Once the device is in the correct position between the user's thighs and the device is centered underneath the user similar to sitting on a bar stool, the user can determine if he or she feels stable enough to maintain that position while floating. FIG. 16 displays a user 110 sitting on personal flotation device 200, with thighs pressed against two proximal sides 220 of raised leg straddle support 214. In FIG. 16, the user is floating too high in the water, because the buoyancy of the device 200 is too great; unless the user stays alert and exerts great effort the user is likely to be capsized as if attempting to sit on an underwater basketball.

In order to reduce buoyancy, the user 110 slightly unfastens threaded cap 236 from valve stem 234, thereby allowing air to exit the device 200 and water to enter, thereby increasing the ballast and reducing the buoyancy of device 200. The user, still sitting on device 200, sinks in the water up to chest level, as displayed in FIGS. 1A and 1B. The user 110 then retightens the cap 236, thereby setting the new buoyancy level of the device 200. When the user is at the water level displayed in FIGS. 1A and 1B and a buoyancy equilibrium has been reached, the user will be able sit upright and sit on the device seat 212 with minimal effort, while having free use of his or her hands. The user can use his arms and legs to propel through the water, or perform other activities while floating because his hands are free to do so.

Figure 1A:
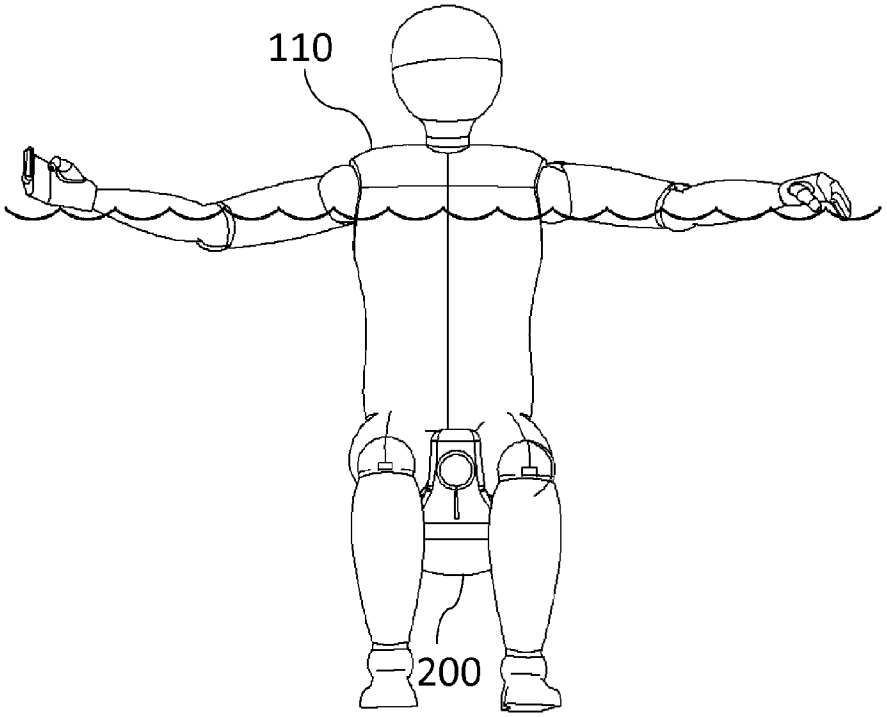
FIG. 1A displays a front view of a user using an embodiment in the water.
Figure 2:
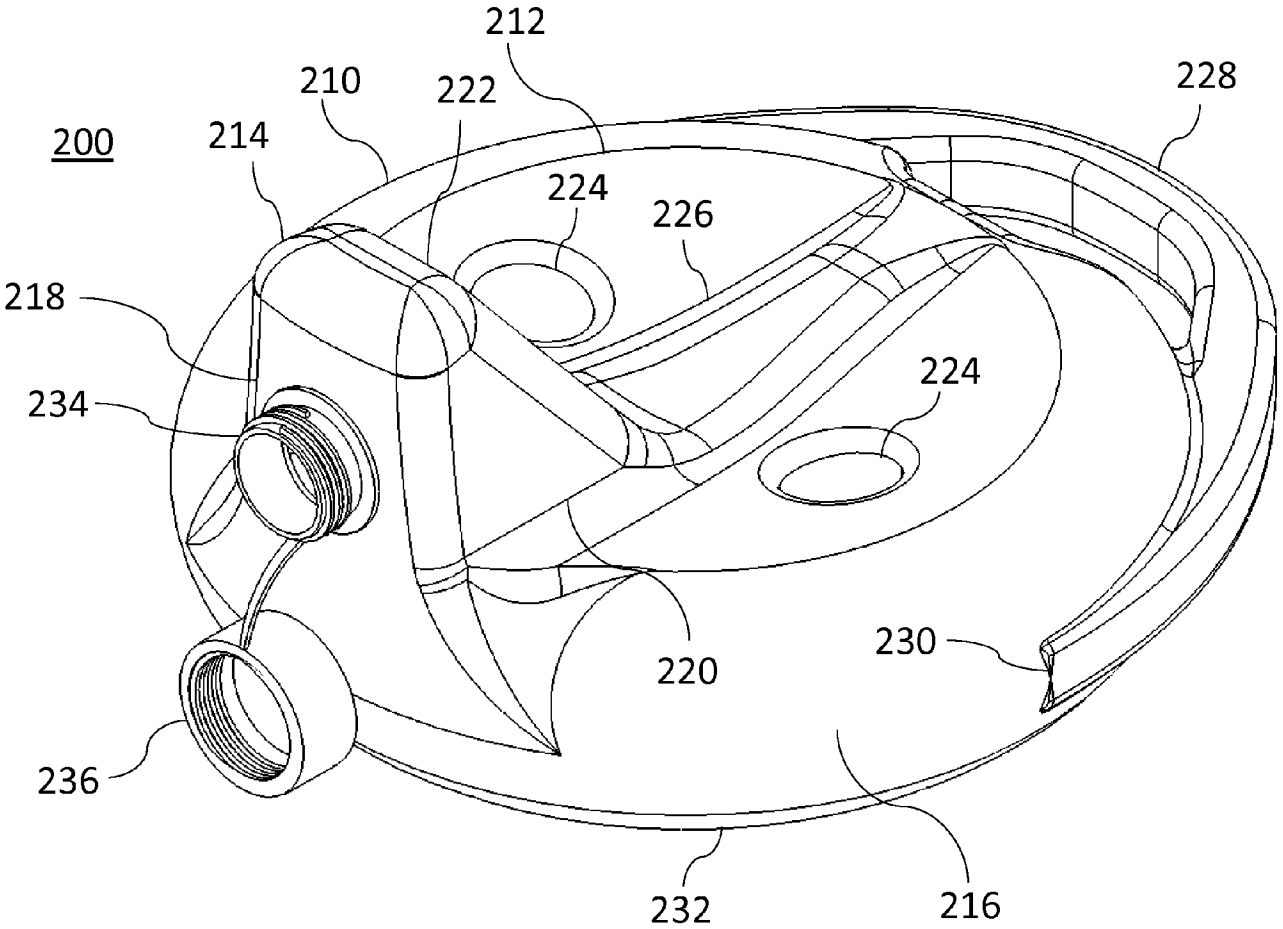
FIG. 2 is a front isometric view of a first embodiment.
Figure 3:
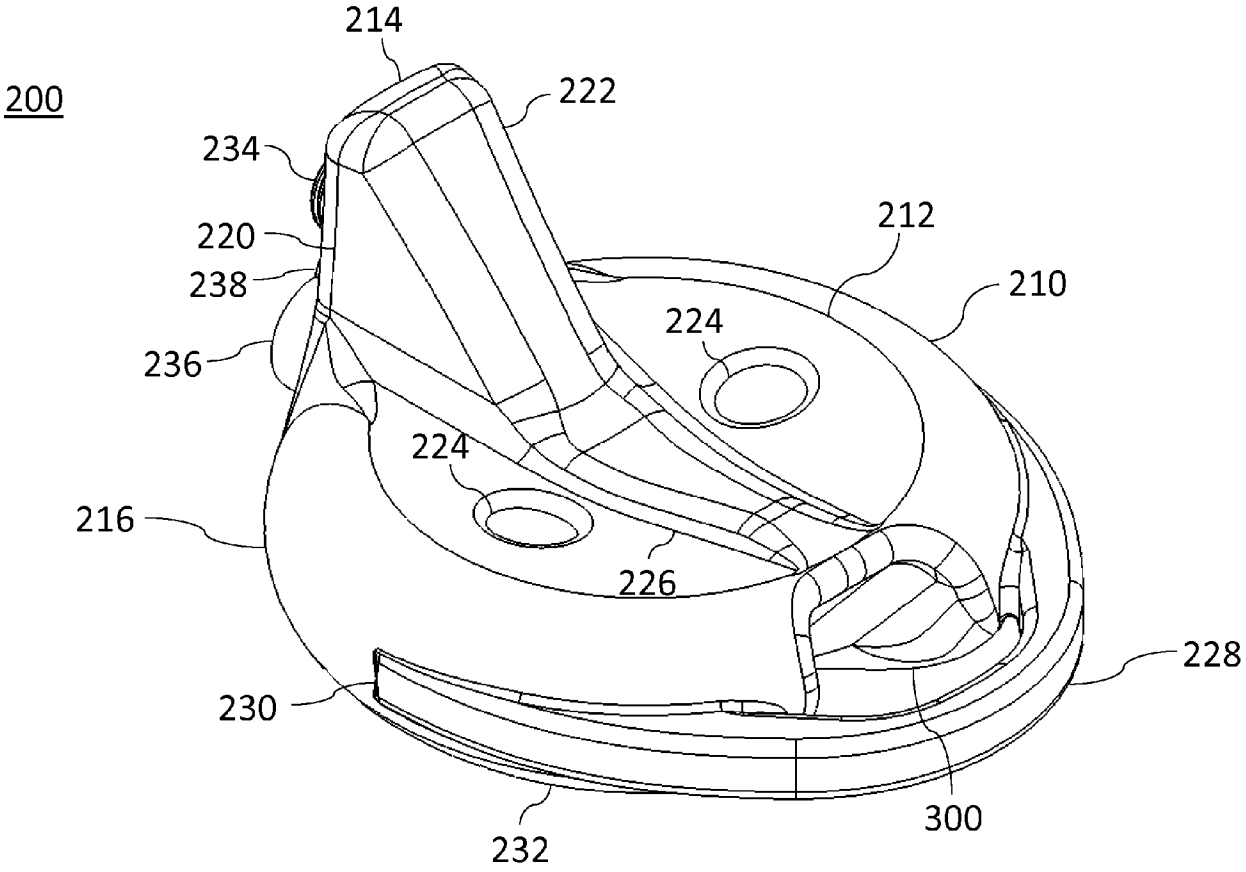
FIG. 3 is a rear isometric view of the embodiment of FIG. 2.
Figure 4:
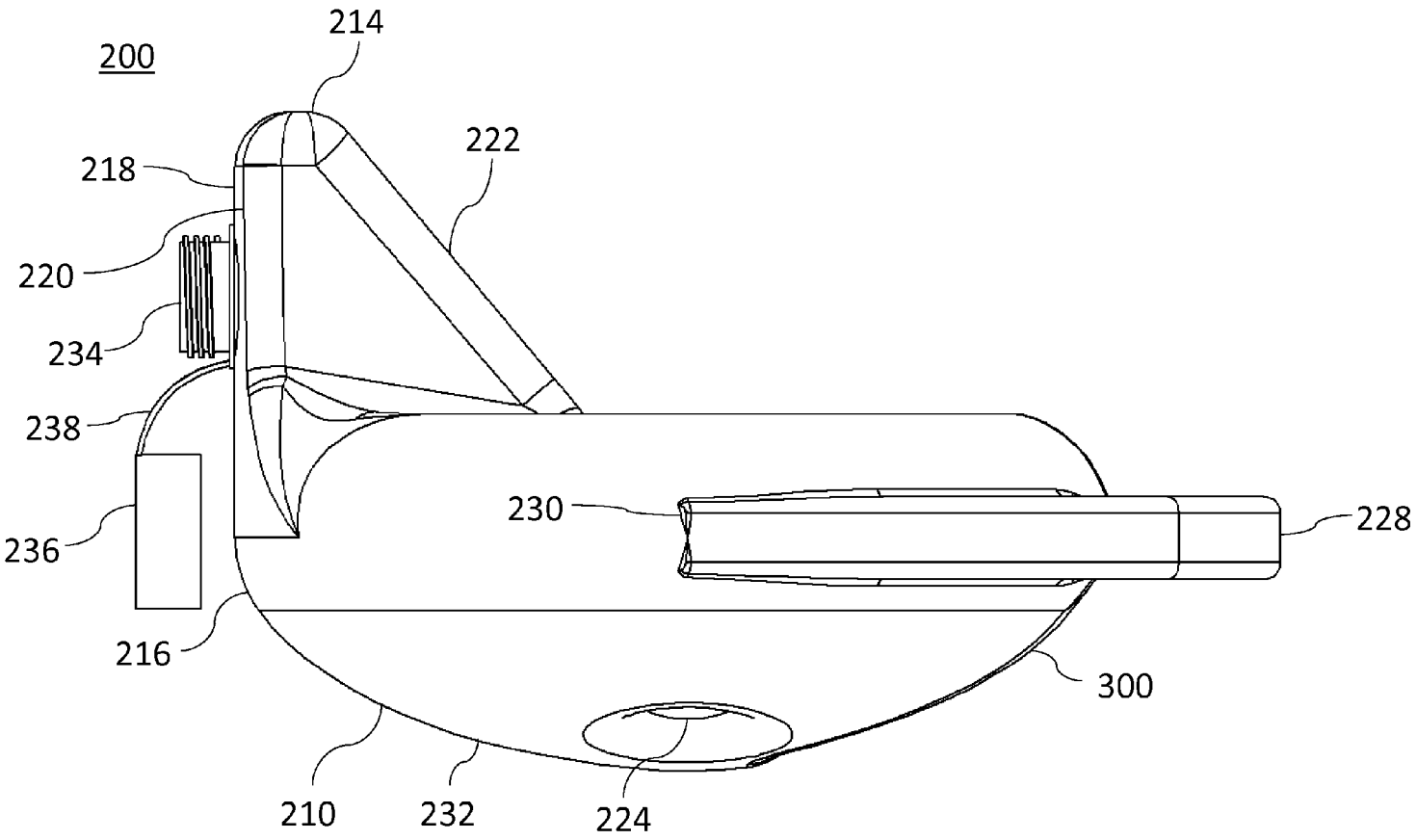
FIG. 4 is a side view of the embodiment of FIG. 2.
Figure 5:
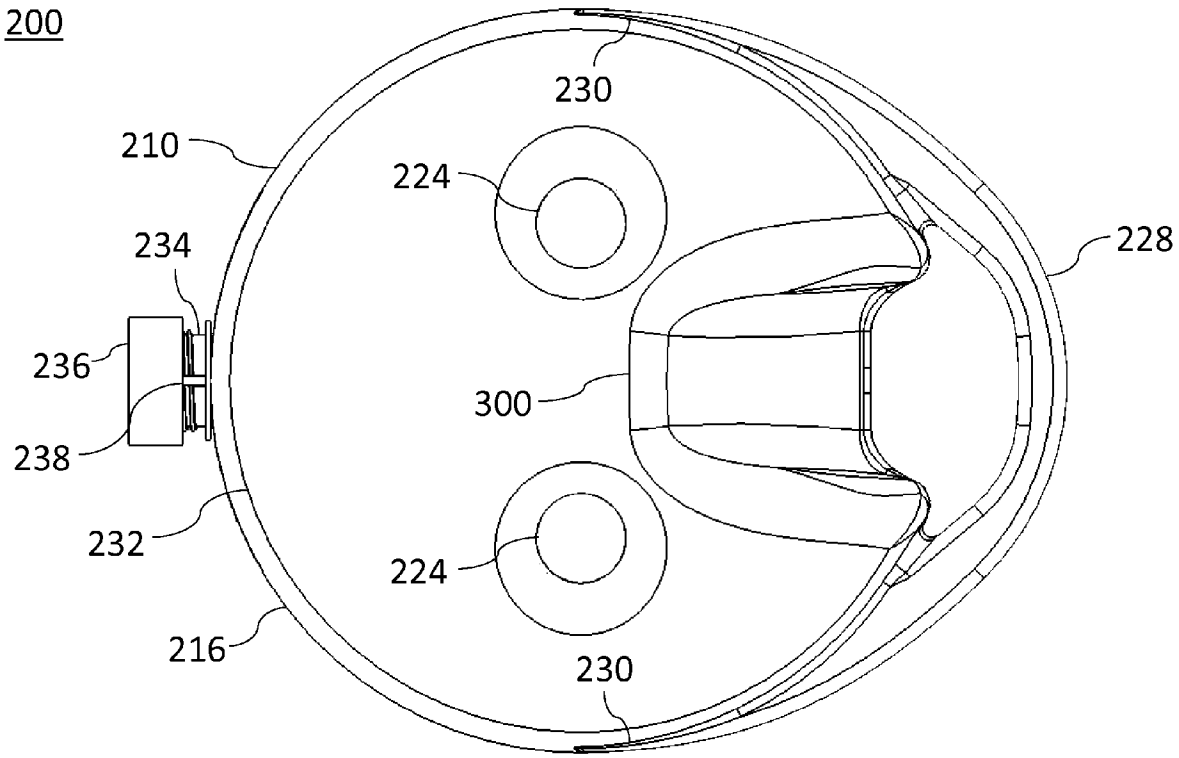
FIG. 5 is a bottom view of the embodiment of FIG. 2.
Figure 6:
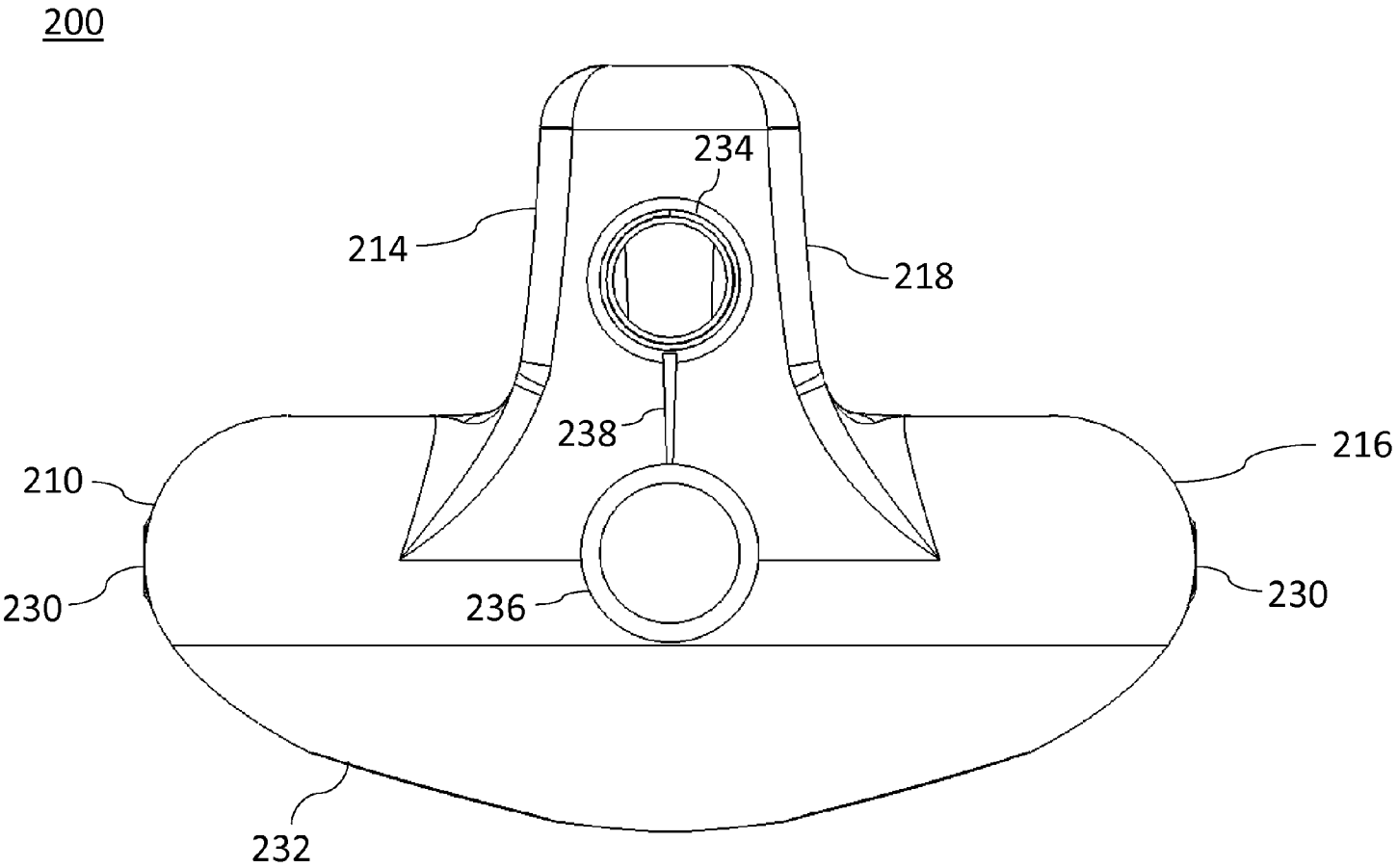
FIG. 6 is a front view of the embodiment of FIG. 2.
Figure 7:
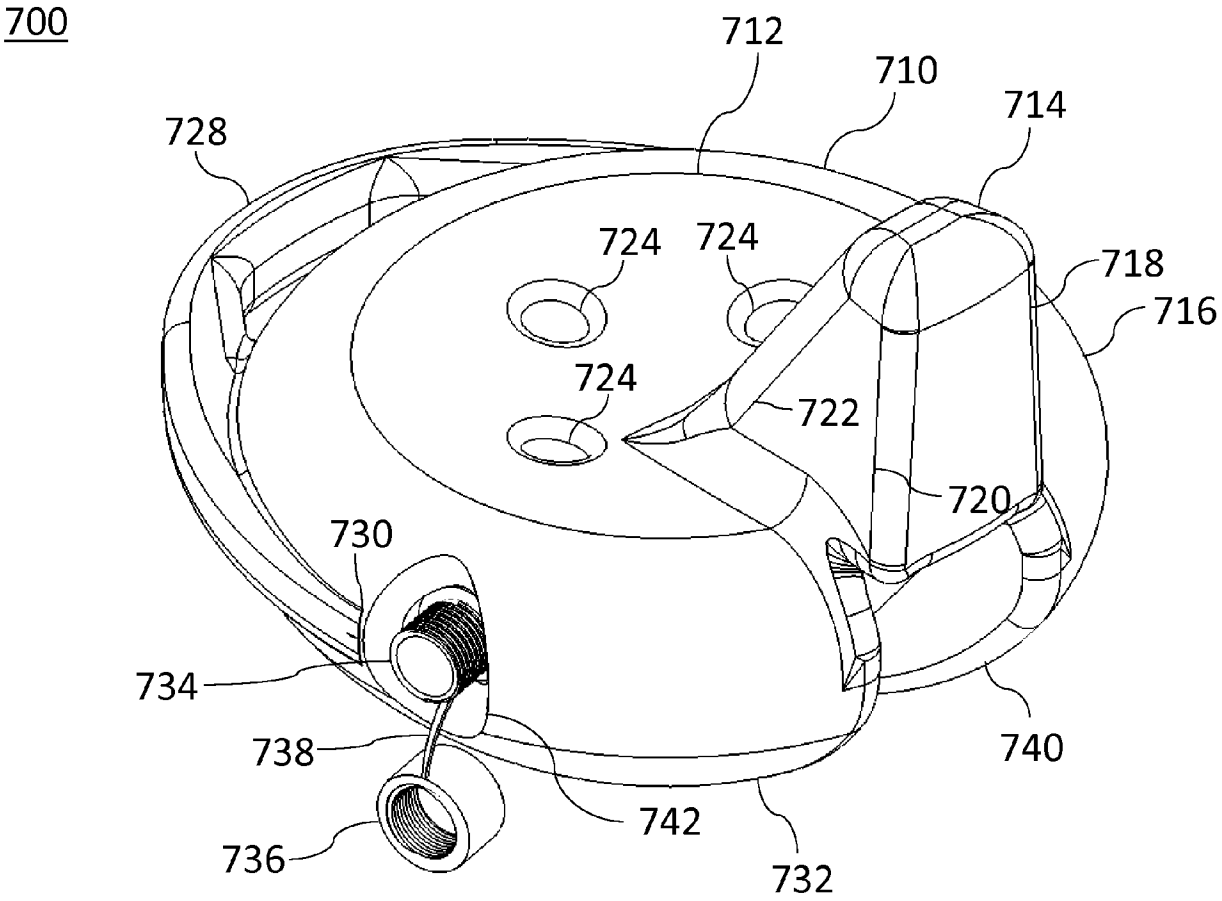
FIG. 7 is a front isometric view of a second embodiment.
Figure 8:
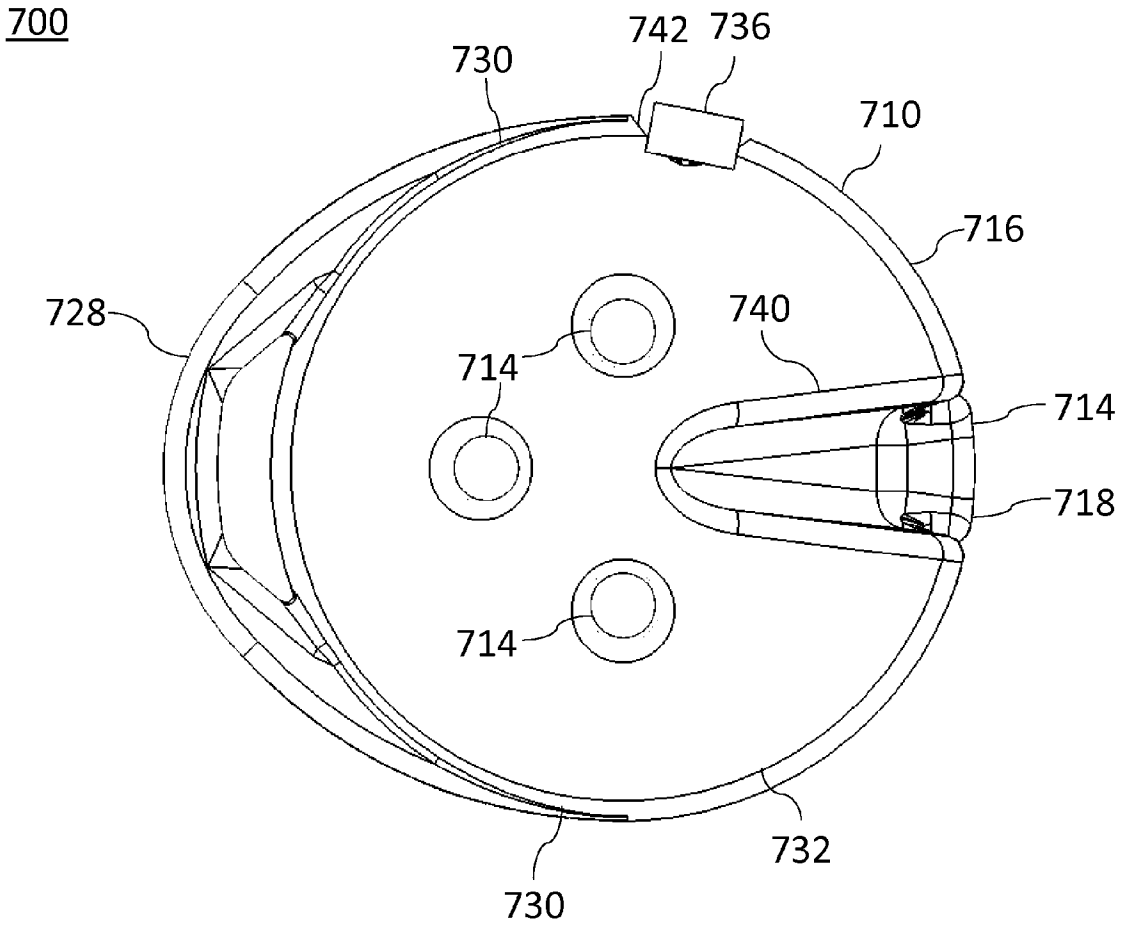
FIG. 8 is a bottom view of the embodiment of FIG. 7.
Figure 9:
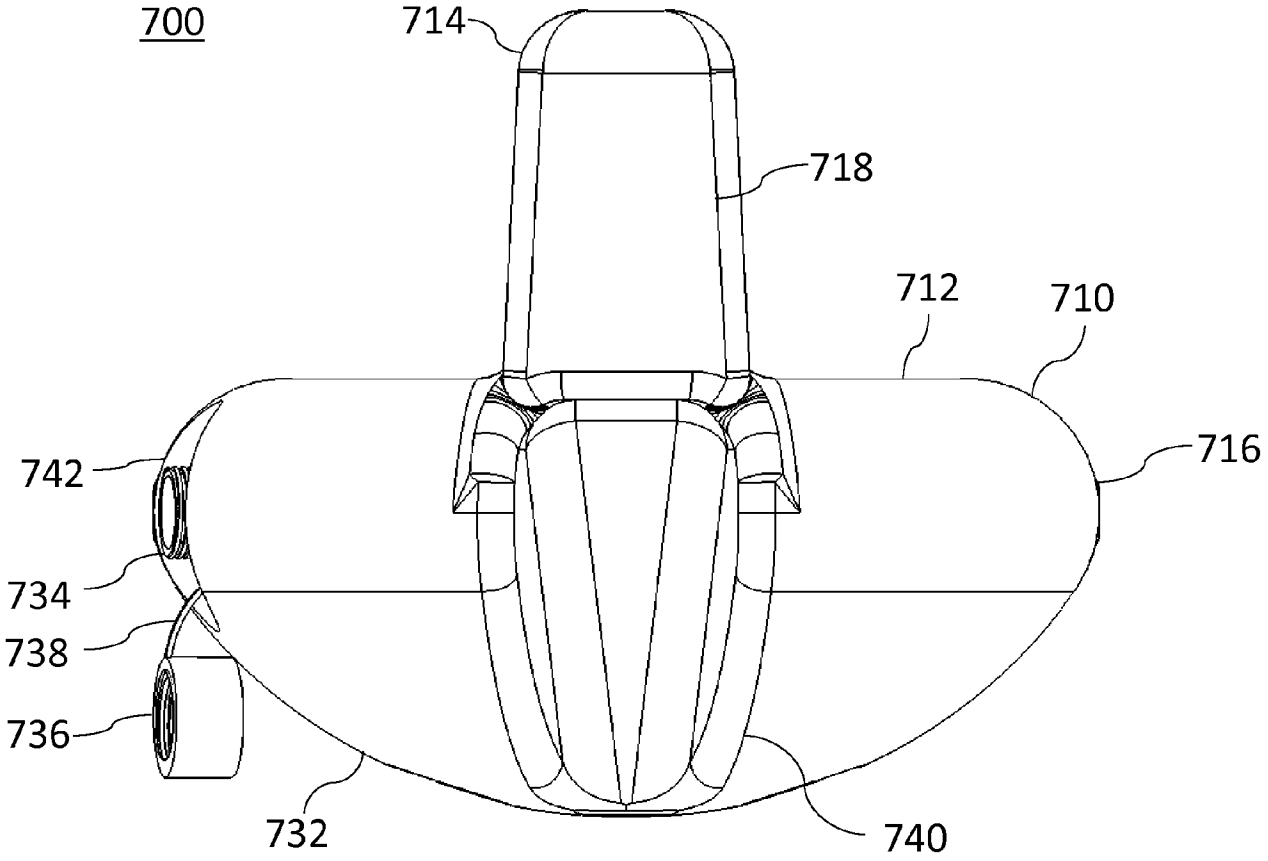
FIG. 9 is a front view of the embodiment of FIG. 7.
Figure 10:
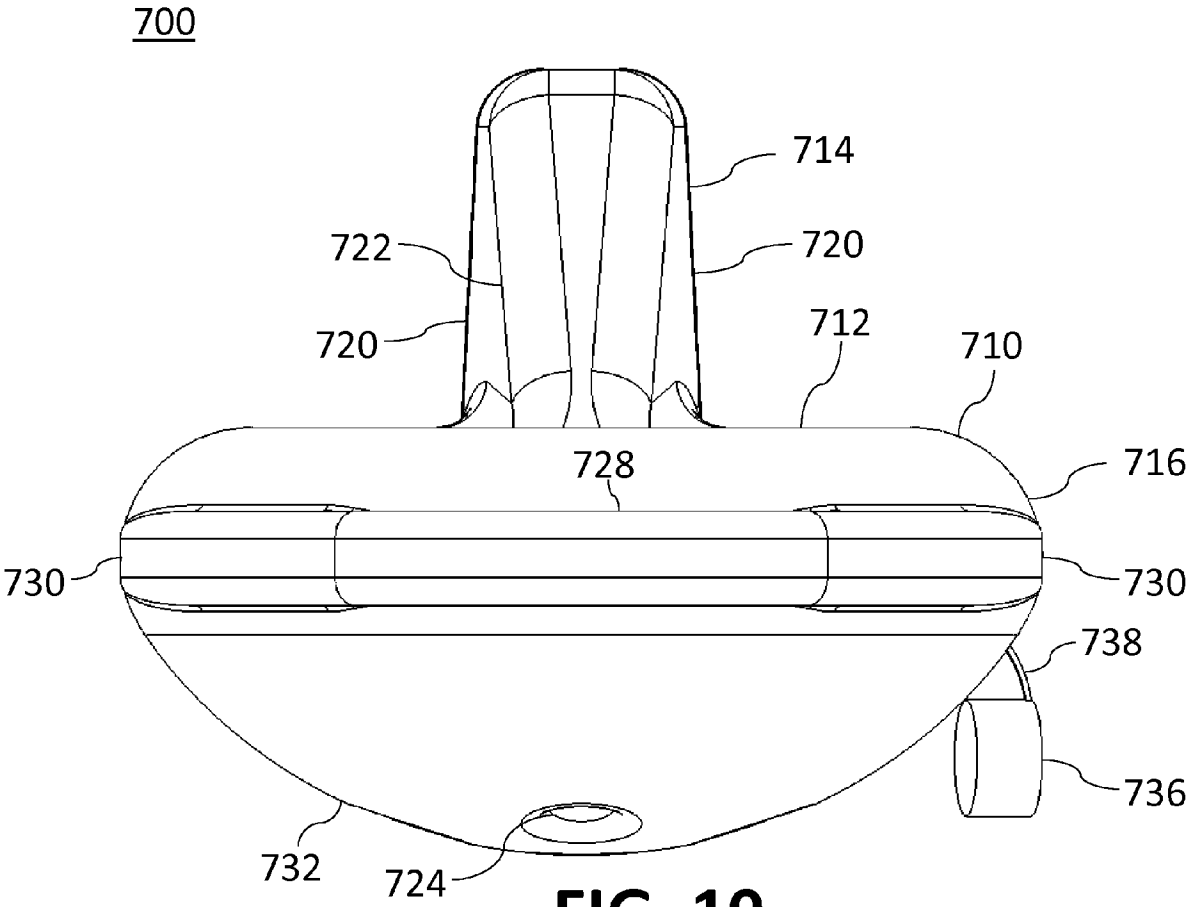
FIG. 10 is a rear view of the embodiment of FIG. 7.
Figure 11B:
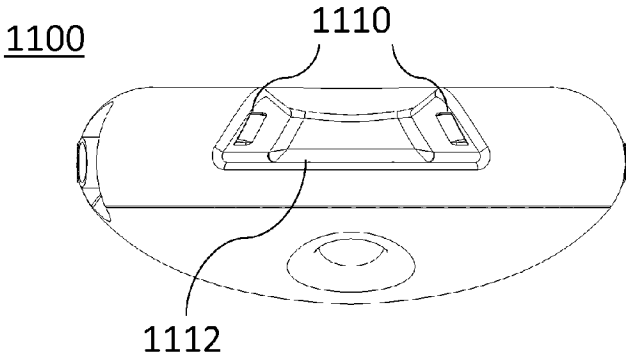
FIG. 11B is a front view of the embodiment of FIG. 11A.
Figure 11D:
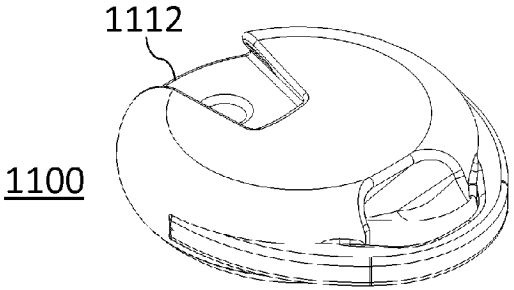
FIG. 11D is a rear isometric view of the embodiment of FIG. 11A.
Figure 11A:
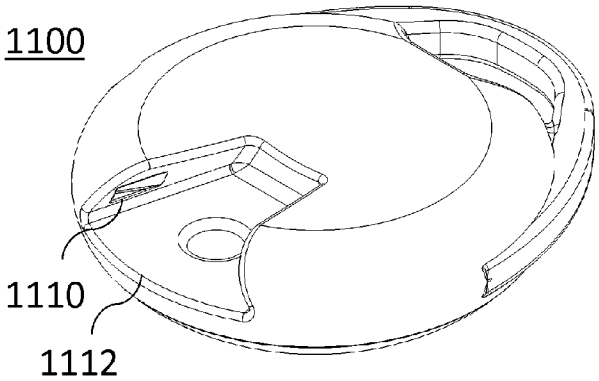
FIG. 11A is a front isometric view of an embodiment without a leg straddle support portion.
Figure 11C:
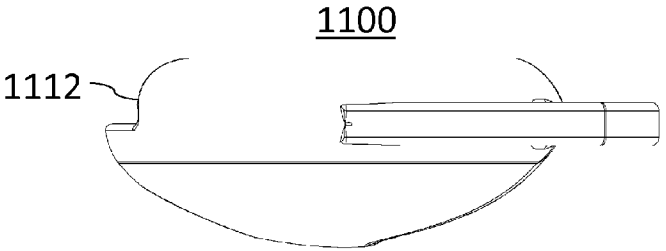
FIG. 11C is a side view of the embodiment of FIG. 11A.
Figure 12B:
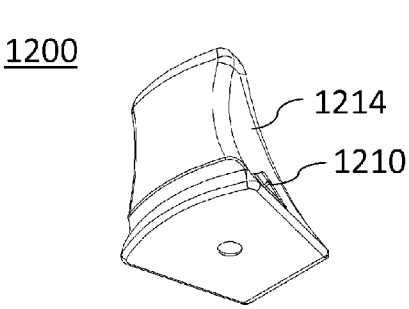
FIG. 12B is a bottom isometric view of the embodiment of FIG. 12A.
Figure 12A:
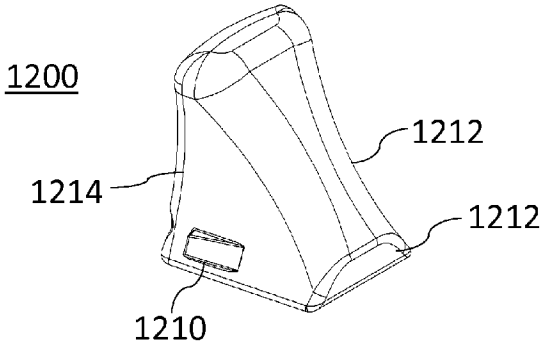
FIG. 12A is a rear isometric view of a leg straddle support for the embodiment displayed in FIGS. 11A through 11D.
Figure 12D:
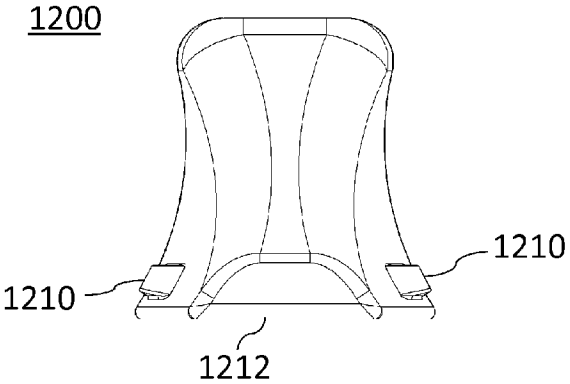
FIG. 12D is a rear view of the embodiment of FIG. 12A.
Figure 12C:
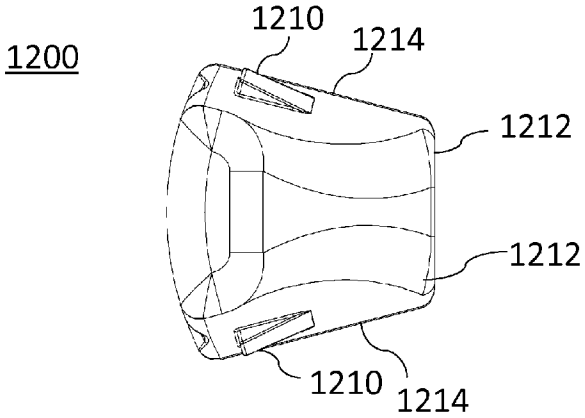
FIG. 12C is a top view of the embodiment of FIG. 12A.
Figure 13B:
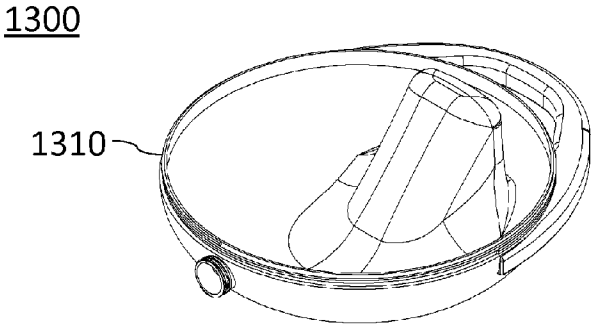
FIG. 13B is a front isometric view of the embodiment of FIG. 13A.
Figure 14B:
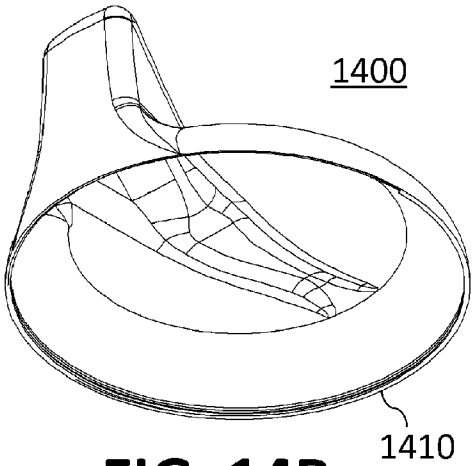
FIG. 14B is a second bottom isometric view of the embodiment of FIG. 14A.
Figure 13A:
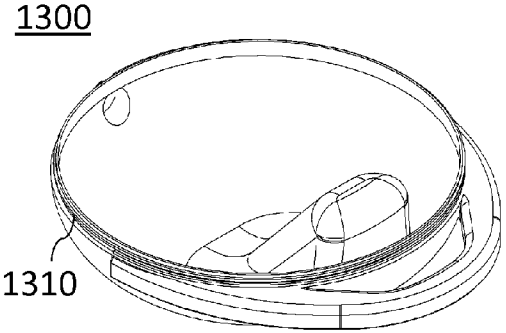
FIG. 13A is a rear isometric view of a bottom half of an embodiment.
Figure 14A:
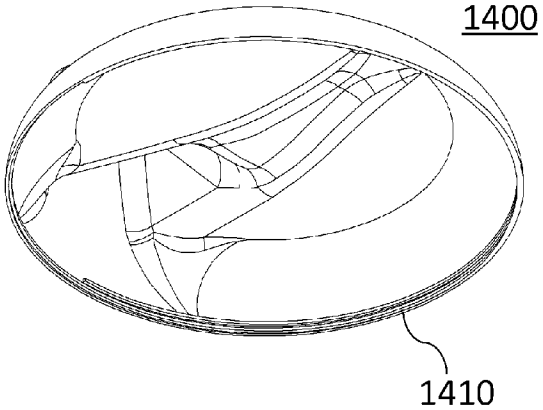
FIG. 14A is a bottom isometric view of a top half complementary to the embodiment in FIG. 13A.
Figure 15A:
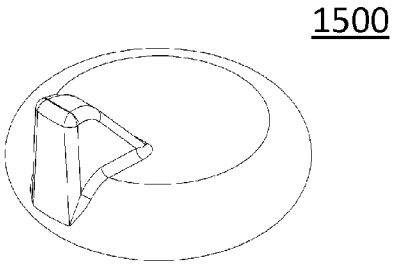
FIG. 15A is a top isometric view of another embodiment.
Figure 15B:
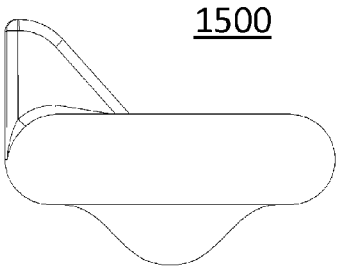
FIG. 15B is a side view of the embodiment of FIG. 15B.
Figure 15C:
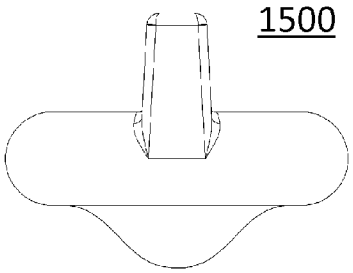
FIG. 15C is a front view of the embodiment of FIG. 15A.
Figure 15D:
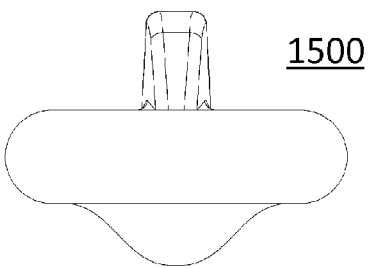
FIG. 15D is a rear view of the embodiment of FIG. 15A.
Figure 17A:
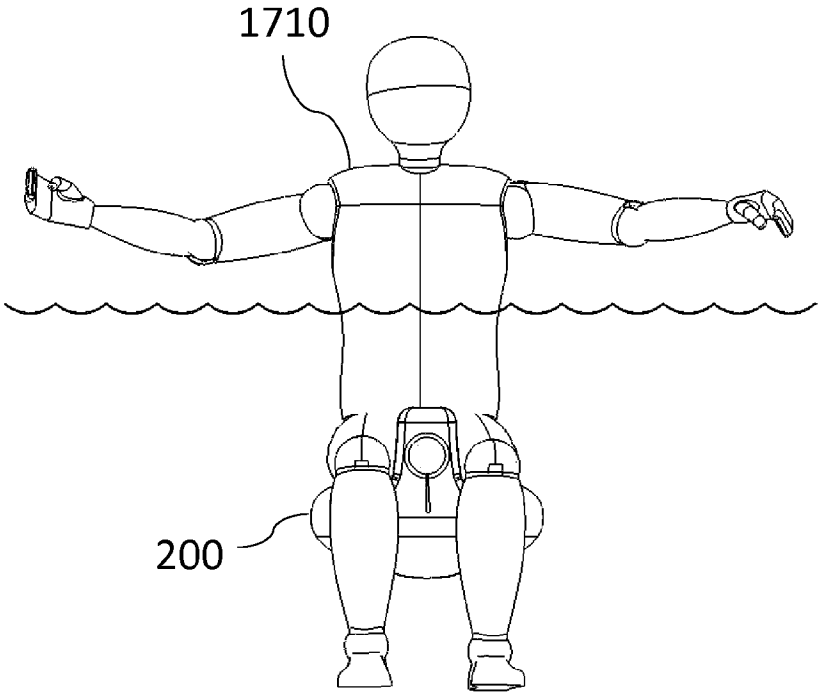
FIG. 17A displays a second user using the embodiment of FIG. 1A.
Figure 17B:
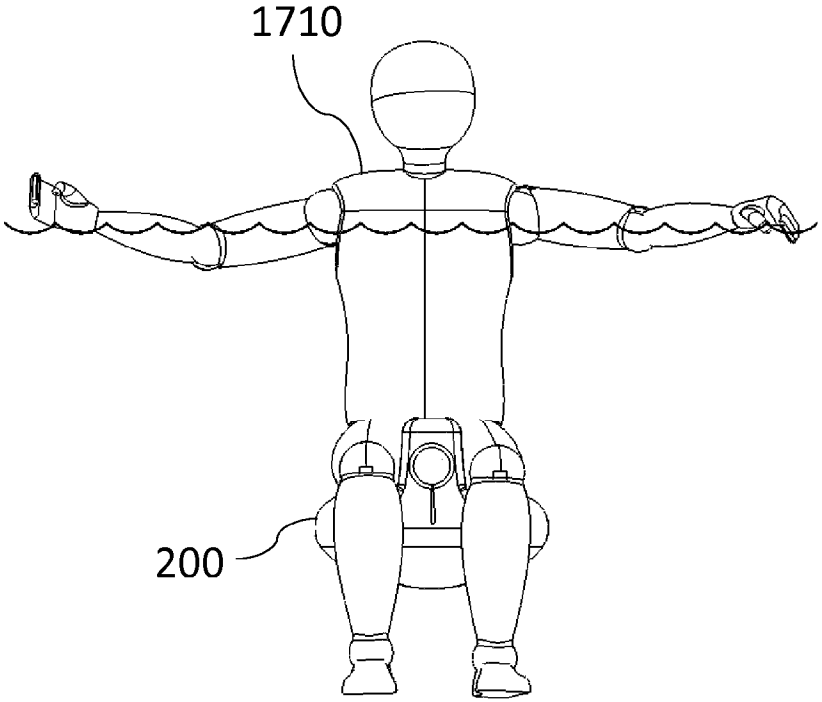
FIG. 17B displays the user of FIG. 17A using the embodiment of FIG. 1A.

FIG. 17A displays a second user 1710 who is smaller than user 110 and has just been given the device 200 at the buoyancy level from FIGS. 1A and 1B. When second user 1710 attempts to use the device 200, the buoyancy of the device that was ideal for the first user is too great for the second user; the second user 1710 floats too high in the water. Like the first user, the second user 1710 opens the water valve 234, thereby reducing the buoyancy of the device 200 even further until the user 1610 is at optimal buoyancy level as displayed in FIG. 17B.

FIGS. 11A, 11B, 11C, 11D, 12A, 12B, 12C, and 12D display a manufacturing option for embodiments, including 200 and 700, where for example laminar flow during the molding process makes it difficult to manufacture an embodiment as a single strong piece. Seat and main body 1100 are manufactured separately from leg straddle support 1200. Recess 1112 is complementary in shape to the lowest section of straddle support proximal sides 1212, 1214. Tabs 1210 are designed in a shape to permanently lock into slots 1110 thereby affixing straddle support 1200 permanently to main body 1110.

FIGS. 13A, 13B, 14A and 14B display a second manufacturing option for embodiments, including 200 and 700. Here, top 1400 includes an outer perimeter of female threads 1410, and bottom 1300 includes an outer perimeter of male threads 1310 that are complementary to female threads, such that when top 1400 and bottom 1300 are screwed together they create a waterproof embodiment, for example 200 or 700.

Several modifications are available to the presented embodiments. By way of example only, straddle support 214 could be cylindrical with indents for the thighs, or T-shaped, or other shapes that allow a user to hold onto the device with the user's legs. As another example, the water valve stem 234 could have a stopper instead of a cap with complementary threads, or some other type of water valve, e.g., a spigot, could be used. More internal support columns 224 can be added if necessary to increase the structural strength of the device and protect it from crushing forces.

While several illustrative embodiments have been described in considerable detail, it is not the intention of the applicant to restrict or in any way limit the scope of the appended claims to such detail. Additional advantages and modifications will readily appear to those skilled in the art. The inventions in their broader aspects are therefore not limited to the specific details, representative apparatus and methods, and illustrative examples shown and described. Accordingly, departures may be made from such details without departing from the spirit or scope of applicant's general inventive concepts.

What is claimed is:

1. A flotation device, said flotation device comprising:
an outer shell, wherein said outer shell comprises a top surface, a side surface, a bottom surface, an inside, and an outside; and
at least one internal support column;
wherein,
said top surface comprises a recessed seat and a vertical raised leg straddle support;
said vertical raised leg straddle support is located directly in front of said recessed seat;
said outer shell includes a water ballast valve connecting said outer shell's inside with said outer shell's outside; and
said outer shell is waterproof and substantially hollow.

2. The flotation device of claim 1, wherein said recessed seat is substantially concave.

3. The flotation device of claim 1, wherein said water ballast valve is a threaded valve stem and a cap coupled to the threaded valve stem with a tether.

4. The flotation device of claim 1, wherein said outer shell is hollow.

5. The flotation device of claim 1, wherein said recessed seat includes a raised middle ridge that is contiguous with said vertical raised leg straddle support.

6. The flotation device of claim 1, wherein said at least one internal support column is two internal support columns, and wherein said two internal support columns extend from said outer shell top surface to said outer shell bottom surface and are hollow and open-ended.

7. The flotation device of claim 1, wherein
Said vertical raised leg straddle support includes proximal sides and a distal side;
said bottom surface includes a cavity having a shape; and
wherein said cavity shape is complementary to said proximal sides of said vertical raised leg straddle support such that said flotation device is stackable on top of another of same said flotation device.

8. The flotation device of claim 7, wherein said water ballast valve is located on said vertical raised leg straddle support distal side.

9. The flotation device of claim 7, wherein said cavity is located directly below said vertical raised leg straddle support.

10. The flotation device of claim 7, wherein said cavity is located below and opposite said vertical raised leg straddle support.

11. The flotation device of claim 1, wherein
said outer shell's vertical raised leg straddle support is a separate piece;
said top surface of said outer shell includes a recess that is substantially complementary in shape to a bottom proximal portion of said vertical raised leg straddle support piece; and
said vertical raised leg straddle support bottom proximal portion is operable to permanently affix to said outer shell at said recess of said top surface.

12. The flotation device of claim 1, wherein said outer shell is comprised of polyethylene.

13. The flotation device of claim 1, wherein said water ballast valve is located on said side surface of said outer shell.

14. The flotation device of claim 1, wherein said outer shell further comprises a handle having two ends and a middle, and wherein said handle ends are located on diametrically opposite sides of said side surface of said outer shell, and wherein said middle of said handle is spaced apart from said outer shell side surface such that a gap exists between said outer shell side surface and said middle of said handle.

15. A personal flotation device for a user of predetermined buoyancy, said personal flotation device comprising:
a seat, a raised leg straddle support, and a bottom;
wherein,
said bottom is substantially convex and substantially dome-shaped;
said raised leg straddle support is in front of and adjacent to said seat;
said personal flotation device has a predetermined buoyancy;
said buoyancy of said personal flotation device is such that when the user sits on said personal flotation device in water, the user sits in equilibrium when a surface of the water is at the user's chest level;
said personal flotation device is waterproof; and
said personal flotation device is operable to be fully submerged under water during use.

16. The personal flotation device of claim 15, wherein said personal flotation device is comprised of styrofoam.

17. The personal flotation device of claim 15, wherein said personal flotation device is inflatable, and wherein said personal flotation device has said predetermined buoyancy when said personal flotation device is fully inflated.

18. The personal flotation device of claim 15, wherein said personal flotation device is hollow.

19. The personal flotation device of claim 15, wherein said seat and said raised leg straddle support are detachable from said bottom, such that said bottom includes a threaded top perimeter and said seat includes a complementary threaded bottom perimeter whereby said bottom and said seat are operable to screw together to form said personal flotation device, such that said personal flotation device is waterproof.

* * * * *